United States Patent [19]
Pierce

[11] 4,339,877
[45] Jul. 20, 1982

[54] HAND-HELD CUTTER FOR CUTTING MOUNTING BOARD AND THE LIKE

[76] Inventor: Donald C. Pierce, 1253 C Redwood Blvd., Novato, Calif. 94947

[21] Appl. No.: 193,884

[22] Filed: Oct. 3, 1980

Related U.S. Application Data

[60] Division of Ser. No. 55,345, Jul. 6, 1979, Pat. No. 4,262,419, which is a continuation-in-part of Ser. No. 22,423, Mar. 21, 1979, abandoned.

[51] Int. Cl.³ ..... B26B 29/00
[52] U.S. Cl. ..... 30/293; 30/310
[58] Field of Search ..... 30/293, 310

[56] References Cited

U.S. PATENT DOCUMENTS

| | | | |
|---|---|---|---|
| 41,797 | 3/1864 | Van Deventer | 30/293 |
| 104,436 | 6/1870 | Durham et al. | 30/293 |
| 2,537,505 | 1/1951 | Baran | 30/293 |
| 3,180,380 | 4/1965 | Franzen | 30/310 |
| 3,191,295 | 6/1965 | Falk | 30/293 |
| 4,030,192 | 6/1977 | Umholtz | 30/310 |
| 4,044,464 | 8/1977 | Schiess et al. | 30/310 |

FOREIGN PATENT DOCUMENTS

| | | | |
|---|---|---|---|
| 25607 | 8/1952 | Finland | 30/293 |
| 120852 | 11/1918 | United Kingdom | 30/310 |
| 273105 | 6/1927 | United Kingdom | 30/310 |
| 698216 | 10/1953 | United Kingdom | 30/310 |

*Primary Examiner*—Jimmy C. Peters
*Assistant Examiner*—J. T. Zatarga
*Attorney, Agent, or Firm*—Owen, Wickersham & Erickson

[57] ABSTRACT

A cutter employing flat replaceable blades and providing a handle and support member that is shaped as an annular segment cut off by a planar surface. The blade is held by a shaft which is preferably encircled by a sleeve and locked to it against rotation. The shaft alone or both the shaft and sleeve extend through a horizontal opening parallel to the planar surface and are locked in place at any desired rotational position. The shaft provides a blade-holding channel enabling ready adjustment of the cutting depth of the blade. In addition to straight cuts and freehand cuts, the latter may be used for circular cuts by attaching a radius rod to it. Cuts of limited length can be simplified by use of another attachment. A further attachment is used to make cuts parallel to the edge of the mounting board.

25 Claims, 24 Drawing Figures

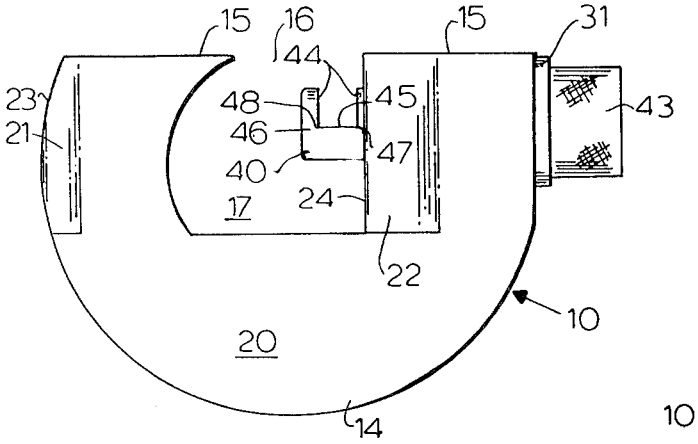
FIG. 6
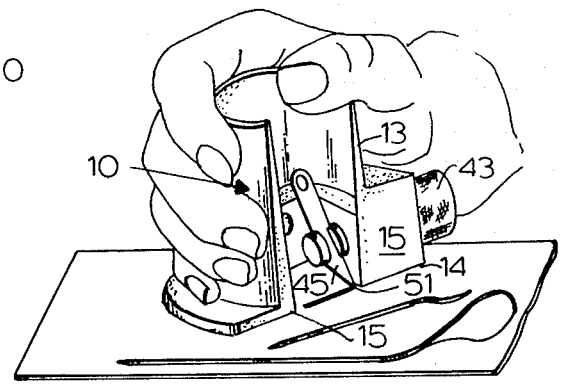
FIG. 8
FIG. 7
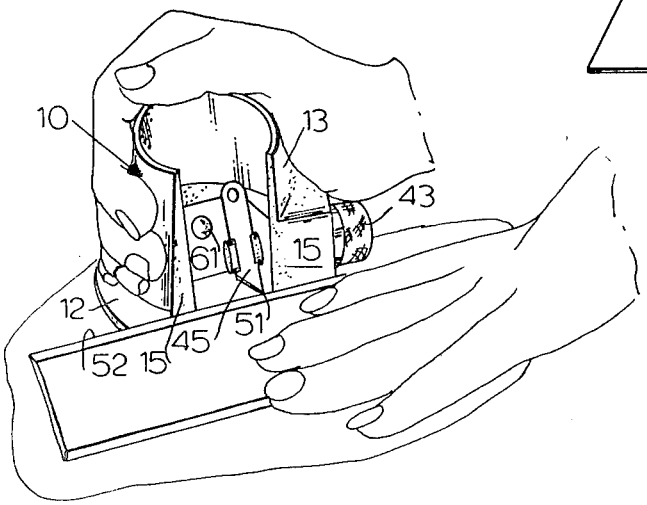
FIG. 9
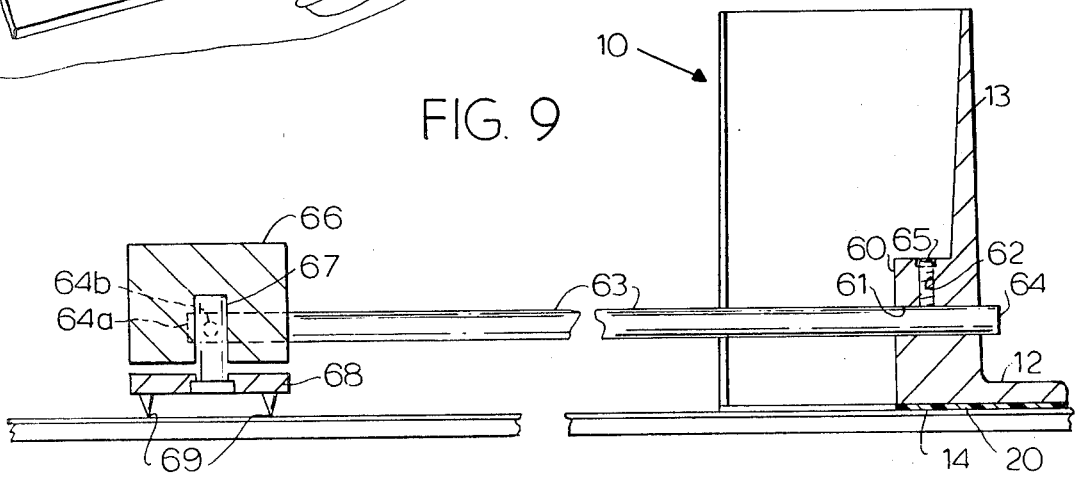

FIG. 13
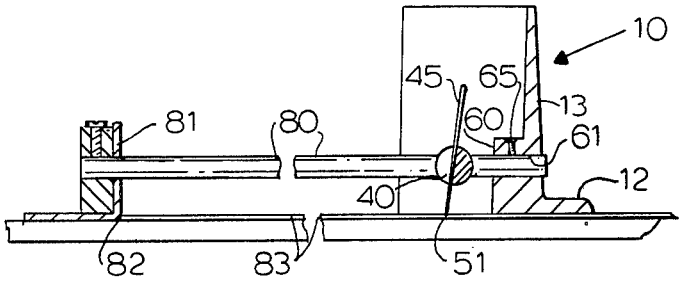
FIG. 16
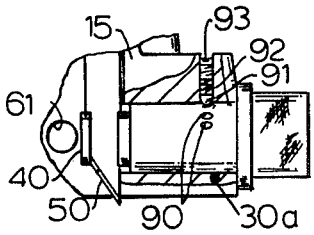
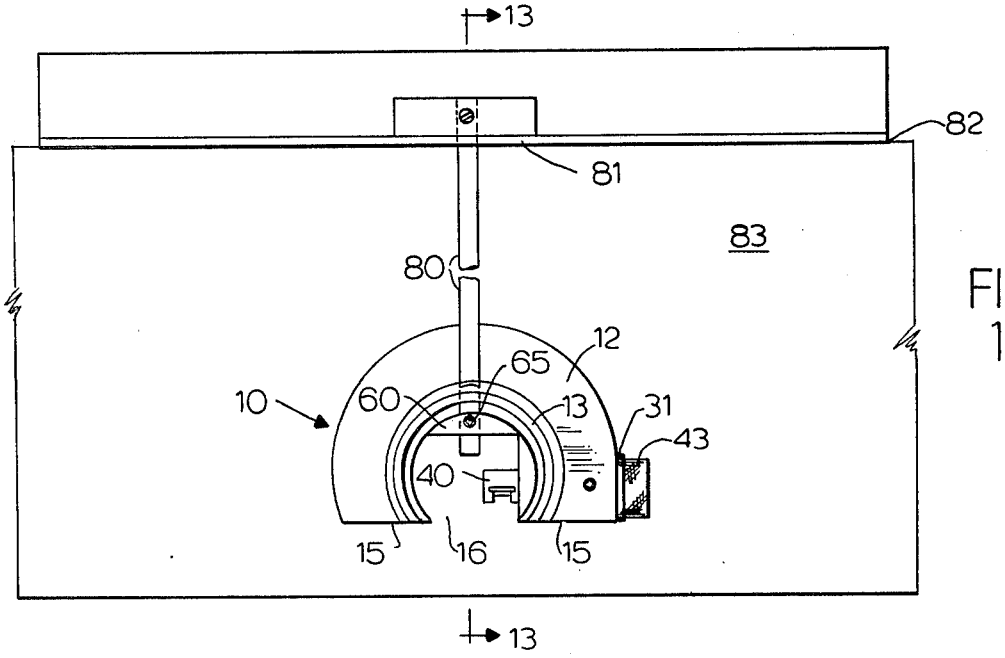
FIG. 14
FIG. 15
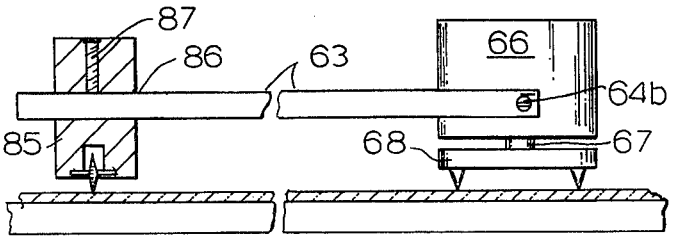
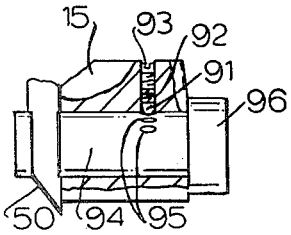
FIG. 17

HAND-HELD CUTTER FOR CUTTING MOUNTING BOARD AND THE LIKE

RELATED PATENT APPLICATION

This is a division of application Ser. No. 55,345, filed July 6, 1979, issued as U.S. Pat. No. 4,262,419 on Apr. 21, 1981, which was a continuation-in-part of application Ser. No. 22,423, filed Mar. 21, 1979, now abandoned.

BACKGROUND OF THE INVENTION

This invention relates to an improved handheld cutter for use in cutting mounting board and like materials.

A standard cutter, long in use for this purpose, and known as the Dexter cutter, is described and claimed in expired U.S. Pat. No. 2,924,010. This cutter enables the use of replaceable cutting blades and enables adjustment of both the cuttng angle and the depth of the cut. However, one cannot adjust the depth of cut without losing the cutting angle, so that has to be reset.

One object of the present invention is to make adjustment of blade depth and of cutting angle easier and to make adjustment of the depth of cut entirely independent from the adjustment of the blade angle.

The Dexter cutter is basically designed for straight cuts, in conjunction with a suitable straight edge. Attachments to enable it to make circular cuts have not proven satisfactory.

Another object of the invention is to provide a simple attachment enabling the cutter to make circular cuts of various radii with the aid of a radius rod.

An additional object is to enable the cutter to cut parallel to an edge of the mounting board, using another simple attachment. Further, the device is well adapted to follow French curves and to make freehand cuts.

Prior-art cutters have been relatively heavy, have occasioned inconveniences in use, have enabled only rather narrow adjustment of the cutting angle, and have even tended to tear mats when making a straight cut. Prior-art cutters have also had a rather high coefficient of friction against the surface being cut, so that cutting often required a considerable amount of manual force.

Other objects of this invention include solving or ameliorating these problems. The device of this invention can be light in weight, easy to handle, convenient to use. The blade may be adjusted to an angle of 45° on either side of vertical. The cutter has a low-friction bottom surface so that cutting requires much less force than heretofore, and the cutter can also be shaped to reduce the liklihood of tearing the mat during cutting.

Still other objects and advantages of the invention will become apparent from the following description.

SUMMARY OF THE INVENTION

The invention provides a handheld cutter for cutting mounting board and the like. The cutter includes a handle-and-support member having a flat base portion and an upstanding hand-engaging portion, both shaped as an annular segment cut off by a generally vertical planar surface extending on both sides of a gap in the annulus. The upstanding hand-engaging portion directly overlies an inner peripheral portion of the flat base portion, and the base portion provides a flange extending out beyond the hand-engaging portion. As will be seen, the gap affords access to the cutting blade for adjusting its cutting depth.

A support block portion adjacent the generally vertical planar surface overlies the flange and adjoins the hand-engaging portion. This block has a cylindrical horizontal opening therethrough parallel to the generally vertical planar surface, and has a generally vertical bearing wall approximately perpendicular to the generally vertical planar surface. A setscrew opening overlies or underlies the through opening. The handle-and-support member generally encloses, except at said gap, a generally cylindrical well, with the base portion and hand-engaging portion defining a generally cylindrical segment inner wall for the well, which is open at the gap. This well also helps to give access to the blade.

A cylindrical shaft has one end threaded and has a blade-holding portion at its other end, providing a channel in which a conventional flat replaceable blade may be installed and slid to a desired cutting depth. In one form of the invention, the shaft has a radially-extending stud or pin spaced away from the blade-holding portion, and a retaining sleeve encircles the shaft for part of its length and extends (with it) through the horizontal opening, a slot at an inner end of the sleeve receives the stud or pin to prevent relative rotation between the sleeve and the shaft, and a flange at an outer end of the sleeve abuts the block's bearing wall. In another form of the invention, the retaining sleeve is absent, and the shaft has a series of indentations to receive a setscrew. In a third form of the invention, the sleeve is short and has a polygonal exterior, and the shaft has an annular groove therein.

A setscrew in the setscrew opening enables locking the sleeve and shaft (or the shaft alone, where there is no sleeve) in any chosen rotational position. A nut, preferably knurled, is threaded on the threaded end of the shaft and clamps and either locks the flange of the sleeve against the bearing wall or itself engages the bearing wall if there is no sleeve. When the nut is loosened, the angular position of the shaft can be changed; otherwise it is retained. Thus, a cutting blade, removably held by the blade-holding portion, can be slid in the channel to adjust its cutting depth without any change in the angular position thereof, and the angular position can be changed without affecting the depth of cut.

Preferably, the cutter also has a second block in the well near the bottom of the inner wall. This second block has a cylindrical opening therethrough facing the gap and extending perpendicularly to the vertical planar surface, but spaced away from it. It has a vertical setscrew overlying the opening, so that, for example, a radius rod can be inserted to a desired location and clamped there, for making circular cuts.

An important feature of the cutter is that the lower surface of its bottom wall is covered with low-friction plastic, such as polytetrafluoroethylene. This may be a separate member or a coating on the bottom wall. Moreover, the generally flat bottom wall is preferably shaped to provide portions that slope upwardly in the normal direction of movement of the device, thereby reducing the likelihood of tearing the delicate surface of a mat.

DESCRIPTION OF THE DRAWINGS

In the drawings:

FIG. 6 is a bottom view, looking along the direction 6—6 in FIG. 3.

FIG. 7 is a view in perspective of the device being used to make a straight cut.

FIG. 8 is a similar view showing the device being used in a freehand cut.

FIG. 9 is a view in elevation and partly in section of the device with a radius rod attachment installed for making a circular cut. The radius rod is broken in the middle to conserve space.

FIG. 13 is a view in elevation and partly in section of the device with another attachment installed for use in guiding rectilinear cuts.

FIG. 14 is a top plan view of the assembly of FIG. 13.

FIG. 15 is a view in elevation and partly in section showing the attachment of FIGS. 9 and 10 in combination with a glass-cutting attachment.

FIG. 16 is a fragmentary view in partial section like a portion of FIG. 3, showing a modification.

FIG. 17 is another fragmentary view in partial section like a portion of FIG. 3 showing another modification.

DESCRIPTION OF SOME PREFERRED EMBODIMENTS

Figure 1:
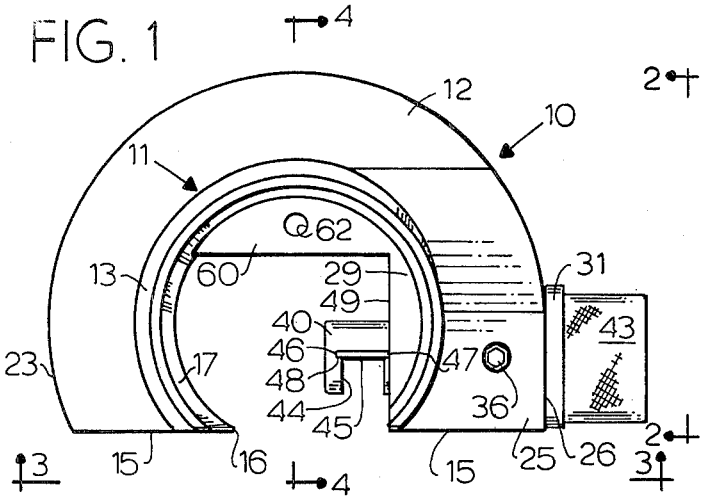
FIG. 1 is a top plan view of a cutter embodying the principles of the invention.
Figure 2:
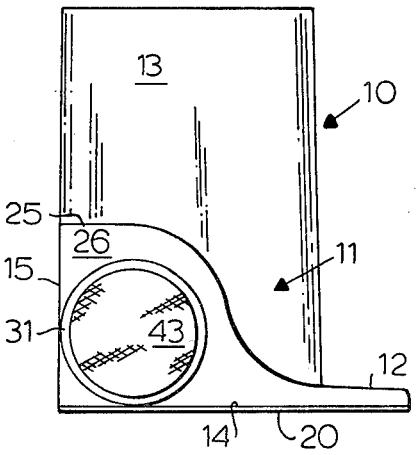
FIG. 2 is a view in elevation of the cutter in the direction indicated by 2—2 in FIG. 1.

The cutter 10 of FIGS. 1 to 8

FIGS. 1–8 show a cutter 10 embodying the principles of the invention and including a handle-and-support member 11, which may be made from a lightweight metal alloy or from suitable plastic, as by injection molding. The member 11 comprises a flat base portion 12 and an upstanding hand-engaging portion 13; there is a generally flat bottom wall 14. The member 11 may be made from metal or from strong low-friction plastic.

Both of the portions 12 and 13 are generally annular, with the base portion 12 providing a flange around the hand-engaging portion 13, but they form only an annular segment terminating at a generally vertical planar surface 15, as though cut there, providing a gap 16, with the surface 15 lying on both sides of the gap 16. This surface 15 is placed against and moved along a suitable straight edge when a straight cut is to be made.

The hand-engaging portion 13 is preferably shaped as a generally cylindrical segment surrounding a well 17 except at the gap 16; however, preferably, the portion 13 has an outer wall 18 that slopes upwardly and inwardly (e.g., at about 2° vertical) so that it is a frustoconical segment; also its inner wall 19 slopes downwardly and inwardly (e.g., at about 2° to vertical), so that it is, very strictly speaking, an inverted frustoconical segment. This shape helps to enable injection-molding of the device. For the same reason, the surface 15 may also slope upwardly and inwardly at about 2°. The gap 16 and well 17 enable visual inspection of the cutter 10 in operation.

Figure 3:
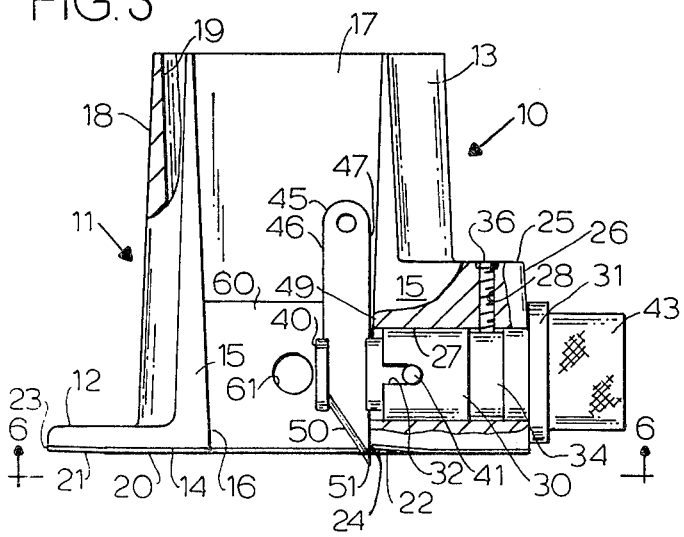
FIG. 3 is a similar view in elevation looking in the direction 3—3 in FIG. 1. Parts are broken away and shown in section.

The generally flat lower wall 14 may be made from low-friction plastic or may be covered with a coating or annular segment piece of low-friction plastic 20 (See FIG. 4), such as polytetrafluoroethylene, so that it is very slick and moves very readily over the surface of the mounting board or other sheet to be cut. To aid in preventing tearing of delicate mounting board surface, all edges of the wall 14 may be rounded or sloped upwardly; also, the wall 14 may have two upwardly sloping portions 21 and 22, as shown in FIGS. 3 and 6, both made of low-friction material or covered with the plastic 20, along which are, in effect, the two leading edges 23 and 24 of the device, when it is used for forward cutting along a straight line, moved parallel to the vertical planar surface 15. These portions 21 and 22 (See FIG. 3) preferably slope up at about 5°–10°, and they help to avoid tearing and bonding of the paper or board being cut by pushing down gradually the material at the cut edge.

The member 11 may be formed to provide a first block portion 25, a thickened portion adjacent to, even actually bounded by, the generally vertical planar surface 15 and having a generally vertical bearing wall 26 generally perpendicular to the surface 15, outside the wall 18 and joining it to the flange 12. The surface 26 may also slope at about 2° from vertical. Through the block 25, as shown in FIG. 3, are a horizontal through opening 27 and a threaded setscrew opening 28 leading, preferably vertically, to the opening 27. The block 25 may also include a portion 29 (See FIG. 1) inside the well 17.

A sleeve 30 extends through the horizontal through opening 27, as shown in FIG. 3. The sleeve 30, as shown also in FIG. 5, has a flange 31 that bears against the bearing wall 26 and a slot 32 parallel to the axis of the sleeve 30 leads in from the opposite end 33. A recessed circumferential portion 34 may be provided for engagement with a setscrew 36 that is threaded into the opening 28, for holding the sleeve 30 in a fixed rotational position.

Figure 4:
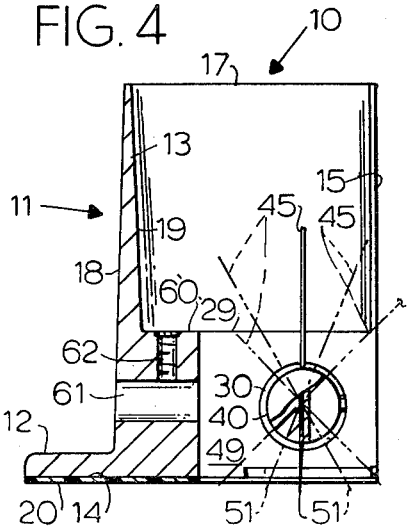
FIG. 4 is a view in elevation and in section taken along the line 4—4 in FIG. 1. Broken lines show the extreme positions and some intermediate positions to which the blade may be tilted.
Figure 5:
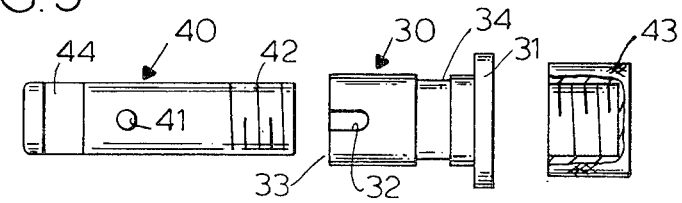
FIG. 5 is an exploded view in side elevation of the shaft, sleeve, and nut, with the nut partly broken away to show its interior.

A shaft 40 fits inside the sleeve 30 and is locked to it against relative rotation by a pin or stud 41 that engages in the slot 32. An outer end 42 of the shaft 40 is threaded to receive a nut 43, preferably knurled, to clamp the flange 31 against the bearing wall 26. Near the inner end of the shaft 40, is a recess 44 to receive a blade 45, which may be a conventional replaceable blade which is an elongated flat strip of metal and has two parallel edges 46 and 47 that fit in a channel 48 of the shaft 40. The depth of cut is determined by sliding the blade 45 in the channel 48 to the desired depth, and is readily adjustable, due to the open well 17 and the gap 16. The angle of the cut is determined by rotation of the sleeve 30 and the shaft 40 in the opening 27 and may readily be varied by 45° on each side of vertical, as shown in FIG. 4. The blade 45 may be further supported by a flat wall 49 of the block portion 29. The wall 49 lies generally perpendicular to the vertical planar surface 15, and one edge 47 of the blade 45 may lie against it. The blade 45 preferably has an angle cut edge 50 with a point 51 at the trailing edge 47.

When used for a straight cut, the blade 45 is normally installed with its trailing edge 47 adjacent the face 49 and is adjusted to the proper depth in the channel 48 and to the proper angle, with the aid of the setscrew 36. The generally vertical planar surface 15 is placed against a straightedge 52 (FIG. 7), and the cutter 10 fits comfortably in the hand so that it can be pushed along the straightedge 52 to make the cut.

The cutter 10, being light and having its low-friction surface 20, may be used freehand if desired, as shown in FIG. 8, or with an irregular curve or in an elliptical path, if desired.

To enable a circular cut and various other uses, the member 11 may be provided with a second block portion 60 having a through opening 61 and a setscrew opening 62. The opening 61 faces the gap 16 and extends substantially perpendicularly to the surface 15.

Figure 10:
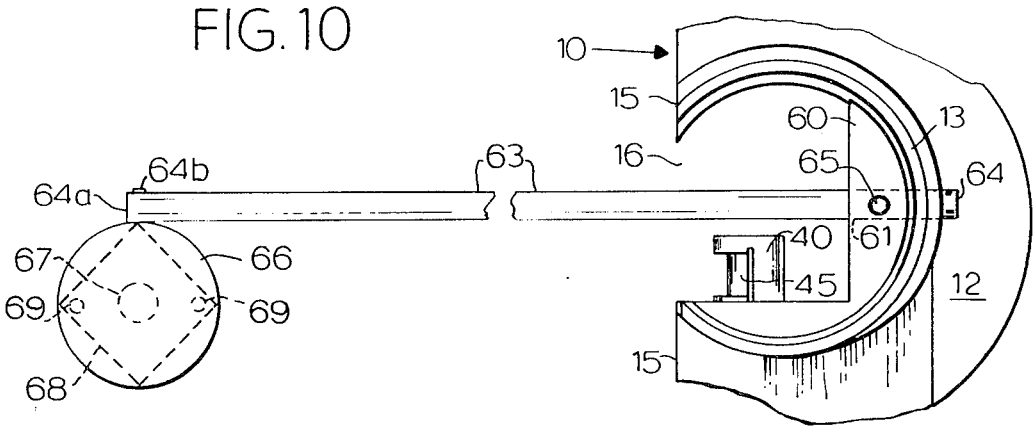
FIG. 10 is a top plan view of the assembly of FIG. 9.

The radius rod attachment of FIGS. 9 and 10

As shown in FIG. 9, a radius rod 63 may be attached by inserting one end 64 through the gap 16 into the opening 61 to a desired amount and tightening a setscrew 65 against it to retain it at the desired radius. The opposite end 64*a* is preferably secured by a single screw 64*b* to a swivel head 66, which is rotatably secured by a shaft 67 to a base 68, having a pair of retaining pins 69. The operator holds the base 68 at a desired center with one hand and swings the member 11 around the circle prescribed by the radius rod to make the cut. The attachment by the single screw 64*b* enables sufficient play for slightly lifting the member 11 relative to an emplaced base 68 to start the knife cut or to insert or adjust the blade, which would be difficult if the attachment were completely rigid.

Preferably, as shown, the base 68 is square; and this enable accurate location of the centerpoint of the shaft 67, and therefore of the center of rotation. Thus, the user can make a pair of mutually perpendicular intersecting lines with a T-square that will enable positioning each of the four corners of the base along one of the lines, and that will, of course, determine the center which lies at the point of intersection of those two lines.

As shown in FIG. 10 especially, it will be clear that the rod 63 is secured to the swivel member 66 with its axis at a distance from the center exactly equal to the distance, along a parallel line, of the axis of the rod 63 to the point 51 of the knife blade 45. This means that when the cutter 10 is swung around a circle, using the offset radius rod 63 to define the radius of the circle, the knife blade 45 makes a cut which is a true circular cut around the chosen center and at the radial distance from blade 45 to the center of the base 68.

The radius rod 63 can be inserted so that the base 68 is on the opposite side of the cutter 10, if desired, by simply reversing the installation of the rod 63 and putting it into the hole 61 from outside.

Figure 11:
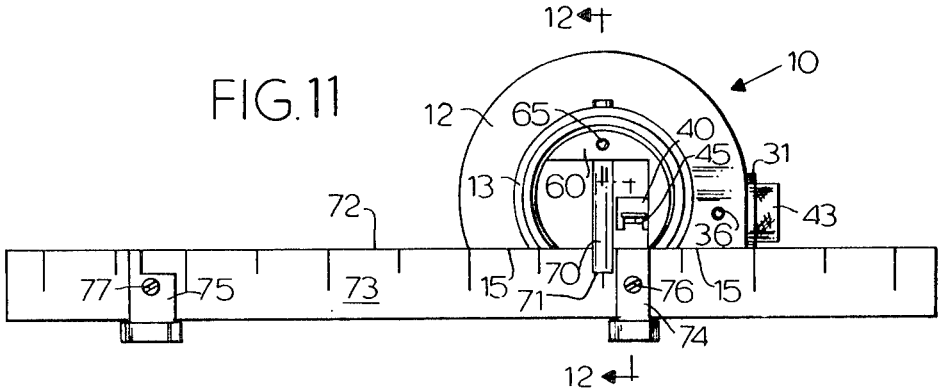
FIG. 11 is a top plan view of the device with a short stop-sensitive rod installed and shown in conjunction with a calibrated cut-limit device.
Figure 12:
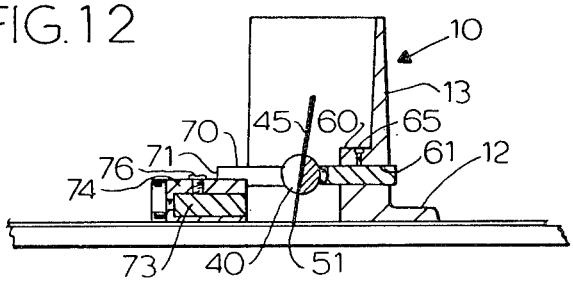
FIG. 12 is a view in section taken along the line 12—12 in FIG. 11.
Figure 18:
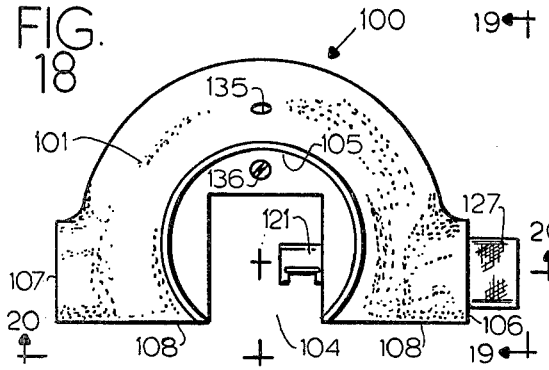
FIG. 18 is a top plan view of another modified form of the invention.
Figure 19:
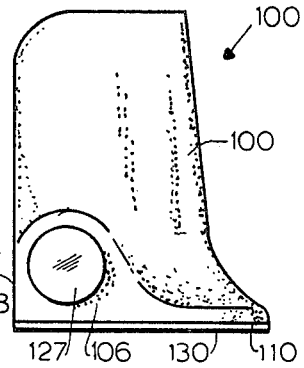
FIG. 19 is a view in end elevation thereof looking from the right at FIG. 18.
Figure 20:
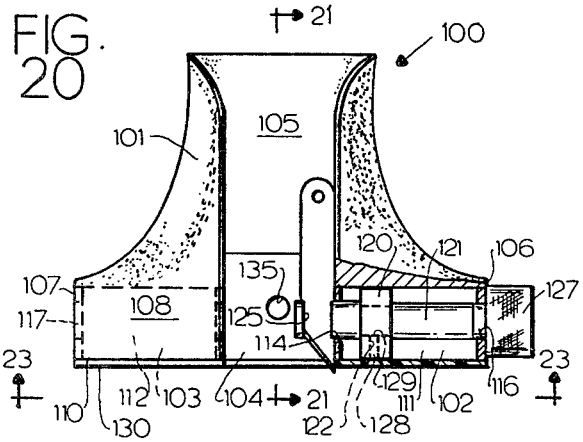
FIG. 20 is a view partly in side elevation and partly in section taken along the line 20—20 in FIG. 18.
Figure 21:
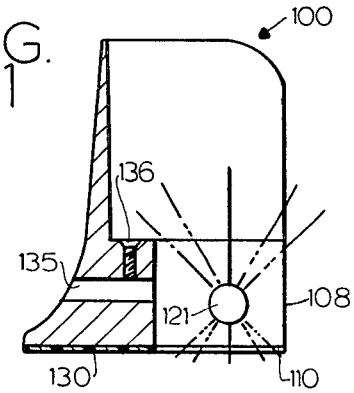
FIG. 21 is a view in section taken along the line 21—21 in FIG. 20.
Figure 22:
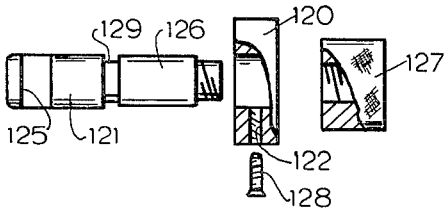
FIG. 22 is an exploded view of the blade-holding assembly.
Figure 23:
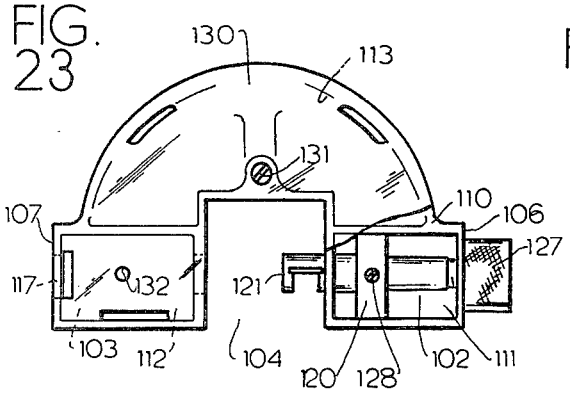
FIG. 23 is a bottom view looking up along the line 23—23 in FIG. 20 with a portion of the transparent plastic bottom broken away.
Figure 24:
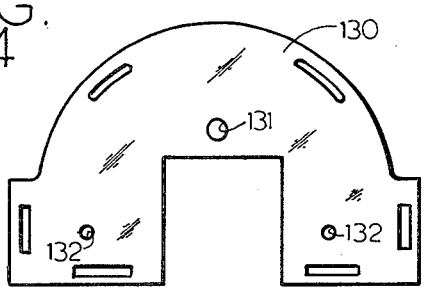
FIG. 24 is a bottom view of the plastic bottom cover.

The controlled cut length attachment of FIGS. 11 and 12

Another attachment, shown in FIGS. 11 and 12, is useful in making cuts of a specified length. In this instance, a short rod 70 is installed in the opening 61 and held in place there by the setscrew 65. This rod 70 is fairly short but does project through the gap 16 beyond the substantially vertical surface 15 to an end 71. Its use is shown in FIG. 11 where a straightedge 72 is provided as one edge of a calibrated rule 73 and where there are two adjustable stop members 74 and 75, each having a setscrew 76,77 so that each can be secured anywhere along the rule 73. Thus, when these stop members 74 and 75 are set in place, there is both a starting point and an end point for a cut to be made with the blade 45. The cutter 10 is then moved along the straightedge 72 and the blade 45 cuts as it moves. Since the blade 45 is offset from the rod 70, the limit or stop members 74 and 75 should be offset the same amount. This can be done by use of an offset calibrated line or by other adjustments, so that although the blade 45 actually starts and stops at a somewhat different location from that of the rod 70, the cut is properly located. This device can be used also for repetitive cuts of a given length.

The edge-guiding attachment of FIGS. 13 and 14

In another form of the invention shown in FIGS. 13 and 14, the cutter 10 is attached to a rod 80 having at its outer end a square, i.e., an angle member 81. This square 81 can be moved along the edge 82 of a piece of mounting board 83, for example, in which a cut is to be made at a defined distance from that edge 82, and the rod 80 and square 81 retain the specified distance so that the cut is perfectly parallel to the edge 82. The movement of the assembly is coupled with the movement of the square 81 along the edge 82.

A glass cutter (FIG. 15)

As can be seen in FIG. 15, the circle-cutting device of FIGS. 9 and 10 may be used in conjunction with a glass cutter 85, which is provided with a suitable opening 86 and a setscrew 87 for locating the position of the glass cutter 85 along the rod 63. In this instance, the glass cutter 85 replaces the cutter 10 and marks the glass in the usual manner, enabling a circular cut to be made.

Set positions for knife angle (FIG. 16)

FIG. 16 shows a modification in which the sleeve 30*a* is provided with a series of indentations or pockets 90 (for example, they may be spaced 15° apart and on each side of the true vertical position, as at 15°, 30°, and 45° on each side of vertical). In this event, the setscrew 36 of FIG. 3 is replaced by a detent 91 which is urged into an indentations 90 by a spring 92, the spring 92 being compressed by a screw 93. Thus, instead of continuous variability there are set positions.

A sleeveless device (FIG. 17)

FIG. 17 shows that the use of set positions can also be accomplished without any sleeve. Here, again, are the detent 91, the spring 92, and the screw 93. A shaft 94 is like the shaft 40, but is has no pin or projection 41, and it does have indentations or pockets 95 like the indentations 90. No nut 43 is needed, for the spring-urged detent 91 can hold the shaft 94 in place both rotationally and longitudinally. The shaft 94 preferably has a handle 96 for use in rotation.

The device of FIGS. 18–24

FIGS. 18–24 show another modified form of the invention which is basically similar to the device of FIGS. 1–8 but which has some significant differences.

A cutter 100 has a handle and support member 101 generally similar to that of the cutter 10 but having less taper and less pronounced shoulders, and it provides two facing horizontal through openings 102 and 103 on opposite sides of a gap 104 like the gap 16. A well 105 is like the well 17 of the device 10 and will not be additionally described. The use of the two openings 102 and 103 makes it possible to mount the knife assembly on either side of the gap. In both instances, there is a generally vertical bearing wall 106,101 generally perpendicular to a surface 108 corresponding to the surface 15.

The bottom surface 110 of the member 101 may be shaped to enable manufacture of extrusion and may be provided with a series of recesses 111, 112, and 113, the recesses 111 and 112, respectively, underlying the horizontal passages 102 and 103. The horizontal passages 102 and 103 are thus provided by the recesses 111 and 112 and two openings each, 114,115 and 116,117, the openings 114 and 116 being at the well 105 and the openings 115 and 117 at the bearing walls 106,107. Each of the recesses 111,112 is preferably shaped rectangularly to receive a polygonal sleeve 120, preferably square, which fits around a shaft 121 and is provided with a setscrew opening 122 extending from its outer surface 123 to its inner surface 124. The shaft 121 has a knife-holding portion 125 and a threaded exterior portion 126; a simple nut 127 is threaded on the portion 126 and bears against the bearing wall 106. The rotational position of the shaft 121 is obtained by rotation of the shaft 121 relative to the sleeve 120, followed by tightening the setscrew 128 so that it engages the shaft 121. For this purpose it is preferable to provide an annular groove 129 within which the setscrew 128 extends down to the surface of the shaft 121. With the sleeve 120 and shaft 121 in place, a cover 130 is placed on the bottom. This cover 130 may be a low-friction plastic member or a plastic member with a low-friction coating on it. It may be generally semicircular and be held to the handle and support member 101 by a suitable screw 131. Holes 132 and 133 are provided to afford access to the setscrew 128 in either of the cavities 111 and 112. The screws 128 and 131 may have Allen heads. The plastic cap 130 provides a low-friction bottom just as in the previous device.

The member 101 also has an opening 135 for attachment of a radius rod or like attachment and a setscrew 136. The cutter 100 is thus basically the same as the cutter 10.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting. For example, the number 11 may be made in two pieces, an upper, generally cylindrical segment and a lower portion providing the flat bottom. The two portions may be made from plastic or metal, or one from plastic and the other from metal. As another example, a less versatile cutter 10 may comprise a member 11 with means for holding a blade in two or three angular positions, as by two sets of slots in which the blade is slidable.

I claim:

1. A handheld cutter for cutting mounting board and the like, including in combination:

a handle and support member shaped as an annular segment bounded by a pair of aligned substantially vertical planar surfaces extending on both sides of a gap in the annulus, and having a generally flat bottom wall and an upstanding hand-engaging portion, said handle and support member having a generally cylindrical wall, a first horizontal through opening generally parallel to said planar surfaces, a generally vertical wall around the outer end of said first through opening, and a second horizontal through opening extending perpendicularly to the direction of said first through opening and facing said gap, a blade-holding means extending through said first through opening and rotatable therein and secured to said handle and support member for retaining a cutting blade at a plurality of angular positions and for adjusting the cutting depth of the blade, retention means extending into said first through opening and engaging said blade-holding means in a desired rotational position, a cutting blade adjustably held in said blade-holding means, and a rod attachment extending through and adjustably secured to said second opening.

2. The cutter of claim 1 wherein said generally flat bottom wall has rounded edges and a lower surface of low-friction plastic.

3. A handheld cutter for cutting mounting board and the like, including in combination:

a handle and support member shaped as an annular segment bounded by two aligned substantially vertical planar surfaces extending on both sides of a gap in the annulus, and having a generally flat bottom wall and an upstanding hand-engaging portion, said member having a first horizontal through opening therethrough substantially parallel to said substantially vertical planar surface, having a bearing wall generally perpendicular to said substantially vertical planar surface, a cylindrical shaft extending through said first horizontal opening and having one end threaded and having a blade-holding channel at its other end and having in between its ends a radially outwardly-extending pin, a retaining sleeve encircling said shaft and extending through said first horizontal opening, having an axially extending slot at an inner end for receiving said pin and a flange at an outer end for abutting said bearing wall, sleeve-retention means for locking said sleeve and shaft in a chosen rotational position, including a truly vertical position and any rotational position to 45° of vertical in either direction from said vertical position, a nut on said threaded end of said shaft for releasably locking said sleeve's flange against said bearing wall, a cutting blade slidably and removably held in said blade-holding channel, a second cylindrical through opening facing said gap and extending substantially perpendicularly to said substantially vertical planar surface, but spaced away from it, a rod with one end fitting adjustably in said second cylindrical through opening of said second block, and retention means for holding said rod at a desired position, said rod extending out from said cutter and having a second end therebeyond.

4. The cutter of claim 3 having anchor means secured to said second end of said radius rod for rotatably retaining said rod relative to a fixed center by one hand of an operator while the operator with his other hand rotates said cutter around said center to make a circular cut thereby.

5. The cutter of claim 3 having a rule with a straightedge for engaging said substantially vertical planar surface, a pair of stop members on said rule, and adjustable retaining means for holding each said stop member in a desired position along said rule, said stop members engaging said rod at each of two limit-defining positions.

6. The cutter of claim 3 having an angle member secured to the rod's distal end, for engaging an edge of material to be cut for spacing the cut from said edge.

7. A handheld cutter for cutting mounting board and the like, including in combination:

a handle and support member as an annular segment cut off by a substantially vertical plane to provide a pair of planar surfaces, one on each side of a gap in the annulus, and having a generally flat bottom wall and an upstanding hand-engaging portion and a bottom flange, said member having a first cylindrical horizontal through opening therethrough substantially parallel to said substantially vertical plane, having a substantially vertical bearing wall perpendicular to one said substantially vertical planar surface, and a first setscrew opening overlying and leading into said first horizontal opening, said member also having a second cylindrical through opening facing said gap and extending substantially perpendicularly to said substantially vertical planar surface, but spaced away from it, said member having a second vertical setscrew opening overlying said opening, said handle and support member enclosing, except at said gap a generally cylindrical well open at said gap, a cylindrical shaft extending through said first horizontal opening and having an outer end threaded and having a blade-holding channel at its other, inner end and having in between its ends a radially outwardly-extending pin, a retaining sleeve encircling said shaft and extending through said first horizontal opening, having an axially extending slot at an inner end for receiving said stud and a flange at an outer end for abutting said bearing wall, a first setscrew in said first setscrew opening for locking said sleeve and shaft in a chosen rotational position, a second setscrew in said second setscrew opening, a nut on said threaded end of said shaft for locking said sleeve's flange against said bearing wall, and a cutting blade slidably and removably held in said blade-holding channel, said channel holding said blade in a plane parallel to or coincident with the axis of said shaft, said gap rendering said blade readily accessible for both observing its position and for adjusting its cutting depth, as well as for removal and replacement.

8. The cutter of claim 7 wherein said generally flat bottom wall has a lower suface of low-friction plastic.

9. The cutter of claim 8 wherein the generally flat bottom wall is shaped to provide upwardly sloping portions in a normal direction of travel of said cutter.

10. The cutter of claim 7 having a radius rod with one end fitting adjustably in said second cylindrical through opening of said second block and retained at a desired position thereby by said second setscrew, said rod extending out from said cutter having a second end therebeyond, and anchor means secured to said second end for rotatably retaining said rod relative to a fixed center by one hand of an operator while the operator rotates said cutter around said center to make a circular cut thereby.

11. The cutter of claim 10 wherein said anchor means comprises a square base, a swivel member secured to said rod and rotatably affixed to said base, and a plurality of pointed members projecting down from said base, 12. The cutter of claim 7 having a short limit-defining rod secured in said second cylindrical oening by said second setscrew and extending through and beyond said gap, for enablig the making of a cut between defined limits.

13. The cutter of claim 12 having a rule with a straightedge engaging said substantially vertical planar surface and a pair of stop members on said rule and adjustable to different positions therealong for engaging said limit-defining rod at each of two limit-defining positions.

14. The cutter of claim 7 having a straight rod secured in said second cylindrical through opening by said second setscrew and extending beyond said member and having an angle member secured to the rod's distal end, for engaging an end of material to be cut for spacing the cut from said edge.

15. The cutter of claim 7 wherein said upstanding hand-engaging portion has a generally frustoconical segment outer wall, sloping upwardly and inwardly.

16. The cutter of claim 7 wherein said generally flat bottom wall has a lower surface provided with low-friction plastic to make it easier to slide the cutter over the surface of material to be cut, said lower surface being shaped to provide portions sloping upwardly in a direction parallel to said generally vertical planar surface, both below said blade at the inner edge of said flat base portion and at the outer edge thereof, along the line of forward rectilinear movement of said cutter.

17. A handheld cutter for cutting mounting board and the like, including in combination:

a handle and support member having a flat base portion shaped as an annular segment cut off by a generally vertical plane to provide two planar surfaces extending on both sides of a gap in the annulus, and having a generally flat bottom wall, an upstanding hand-engaging portion also shaped as an annular segment directly overlying an inner peripheral portion of said flat base portion and cut off along the same plane to provide generally vertical planar surfaces extending along both sides of said gap, said base portion providing a flange extending out beyond said hand-engaging portion, and a first support block adjacent one said generally vertical planar surface overlying said flange and adjoining said hand-engaging portion, said first block having a first cylindrical horizontal through opening therethrough parallel to said generally vertical planar surface, and having a generally vertical bearing wall, generally perpendicular to said generally vertical planar suface, said first block having a first setscrew opening overyling said first horizontal opening, said handle and support member generally enclosing, except at said gap, a generally cylindrical well, with said base portion and hand-engaging portion defining a cylindrical segment inner wall for said well, said well being open at said gap, a cylindrical shaft having one end threaded and having a blade-holding portion at its other end and also having a radially outwardly-extending stud spaced away from said blade-holding portion, said shaft extending removably through said first horizontal opening through said first block, with said blade-holding portion in said well and said threaded portion lying outside said first block, said blade-holding portion providing a channel, a retaining sleeve encircling said shaft in between its end portions and extending through said first horizontal opening, being freely rotatable and translatable therewithin, having a slot extending in from an inner end for receiving said stud and a flange at an outer end for abutting said first block's bearing wall, a first setscrew in said first setscrew opening for locking said sleeve in a chosen rotational position, said slot and said stud cooperating then to retain the rotational position of said shaft, a knurled nut for threading on said threaded end of said shaft and for locking said flange of said sleeve against said bearing wall, a cutting blade removably and slidably held in said channel of blade-holding portion, so that its cutting depth is adjustable by sliding it in said channel while its rotational position is fixed by said setscrew, while its rotational position can be adjusted by loosening said setscrew while said cutting depth remains fixed, a second block secured inside the lower portion of said well, said block having a second cylindrical through opening therethrough facing said gap and extending substantially perpendicularly to said generally vertical planar surfaces, but spaced away from them, said block having a second vertical setscrew opening overlying said opening, a second setscrew therein, and a rod having one end fitting adjustably in said second cylindrical through opening of said second block and retained at a desired position therein by said second setscrew, said rod extending out through said gap and having a second end therebeyond.

18. The cutter of claim 17 having anchor means for rotatably holding said second end of said rod at a fixed center with one hand while the operator rotates said cutter around said center to make a circular cut thereby.

19. The cutter of claim 18 wherein said anchor comprises a square base, a swivel member rotatably affixed to said base, and a pair of pointed members projecting down from said base.

20. The cutter of claim 17 having a rule with a scale and a straightedge engaging said substantially vertical planar surface and a pair of stop members on said rule and adjustable to different positions therealong for engaging said rod at each of two limit-defining positions.

21. A handheld cutter for cutting mounting board and the like, including in combination:

a handle and support member shaped as an annular segment bounded by a pair of aligned substantially vertical planar surfaces extending on both sides of a gap in the annulus, and having a generally flat bottom wall and an upstanding hand-engaging portion, blade-holding means secured to said handle and support member along an axis parallel to said planar surfaces for retaining a cutting blade on a plane through said axis and inside said annulus adjacent to said gap and for adjusting the cutting depth of the blade, a cutting blade adjustably held in said blade-holding means, a rod attachment, rod-holding means on said handle and support member for holding said rod attachment horizontally and substantially perpendicularly to said substantially vertical planar surface, said rod attachment comprising a short limited-defining rod extending through and beyond said gap, for enabling the making of a cut between defined limits, a rule with a scale and a straightedge engaging said substantially vertical planar surface, and a pair of stop members on said rule and adjustable to different positions therealong for engaging said limit-defining rod at each of two limit-defining positions.

22. The cutter of claim 1 wherein said rod attachment comprises:

a radius rod with one end secured adjustably to said handle and support member and extending out from said cutter and having a second end therebeyond, and anchor means secured to said second end for rotatably retaining said rod relative to a fixed center by one hand of an operator while the operator with his other hand rotates said handle and support members around said center to make a circular cut thereby.

23. The cutter of claim 22 wherein said anchor means comprises a square base, a swivel member rotatably attached to said base and attached to said rod, and a plurality of pointed members projecting down from said base.

24. The cutter of claim 1 wherein said rod attachment comprises a short limited-defining rod extending through and beyond said gap, a rule with a scale and a straightedge engaging said substantially vertical planar surface, and a pair of stop members on said rule, adjustable to different positions therealong, for engaging said limit-defining rod at each of two limit-defining positions.

25. The cutter of claim 1 wherein said rod attachment comprises:

a straight rod and an angle member secured to the rod's distal end, for engaging an edge of material to be cut, thereby spacing the cut from said edge.

* * * * *

UNITED STATES PATENT AND TRADEMARK OFFICE

CERTIFICATE OF CORRECTION

PATENT NO. : 4,339,877

DATED : July 20, 1982

INVENTOR(S) : Donald C. Pierce

It is certified that error appears in the above-identified patent and that said Letters Patent are hereby corrected as shown below:

Column 7, line 18, "of extrusion" should read --by extrusion--.
Column 7, line 61, "number 11" should read --member 11--.
Column 8, line 28, "secured to" should read --secured in--.
Column 9, line 26, after "member" insert --shaped--.
Column 10, line 11, "thereby" should read --therein.
Column 10, line 23, "oening" should read --opening--.
Column 10, line 37, "end of material" should read --edge of material--.

Signed and Sealed this

*Fourteenth* Day of *September 1982*

[SEAL]

*Attest:*

GERALD J. MOSSINGHOFF

*Attesting Officer*

*Commissioner of Patents and Trademarks*